United States Patent [19]

Norz et al.

[11] Patent Number: 4,850,293

[45] Date of Patent: Jul. 25, 1989

[54] SEWING MACHINE TOP COVER THREAD TRIMMER

[75] Inventors: Wolfgang Norz, Schwieberdingen; Gunter Rohr, Hemmingen; Karl-Heinz Weingartner, Leinfelden-Echterdingen, all of Fed. Rep. of Germany

[73] Assignee: Union Special G.m.b.H., Stuttgart, Fed. Rep. of Germany

[21] Appl. No.: 225,407

[22] Filed: Jul. 28, 1988

[30] Foreign Application Priority Data

Sep. 4, 1987 [DE] Fed. Rep. of Germany ..... 3729581

[51] Int. Cl.[4] ..... D05B 65/00

[52] U.S. Cl. ..... 112/294; 112/253

[58] Field of Search ..... 112/294, 286, 295, 253

[56] References Cited

U.S. PATENT DOCUMENTS 3,998,172 12/1976 Marforio ..... 112/252

4,077,342 3/1978 Steckenrider ..... 112/294 X 4,098,209 7/1978 Schopf ..... 112/298

4,683,828 8/1987 Matsumoto ..... 112/294

FOREIGN PATENT DOCUMENTS 3531595 3/1987 Fed. Rep. of Germany ..... 112/285

3715603 6/1988 Fed. Rep. of Germany ..... 112/285

*Primary Examiner*—Andrew M. Falik

*Attorney, Agent, or Firm*—Emrich and Dithmar

[57] ABSTRACT

A trimming device for trimming a top cover thread from a workpiece on a multiple needle sewing machine having a thread catching device which is movable between a counter-plate and a knife. In operation the top cover thread is picked up by the thread catching device between a workpiece and a top cover thread guide. A top cover thread trap serves as a counter-plate for the thread catching device. The knife is attached to the counter plate with a gap therebetween, with the thread catching device being swingable within said gap.

5 Claims, 4 Drawing Sheets

SEWING MACHINE TOP COVER THREAD TRIMMER

BACKGROUND OF THE INVENTION

The present invention relates to a trimming device for trimming a top cover thread on a multiple needle sewing machine.

A trimming device is known, for example, from German Offenlegungsschrift No. 35 31 595, which describes a movable trimming knife for trimming a top cover thread, which is provided with a hook edge and which is moved mechanically backwards and forwards between a spreader and the workpiece from a diagonal upper rear direction towards the middle of the top cover thread. Because of the alignment of the trimmed top cover thread, this device requires the first new stitch between the top cover thread guide and a thread trap to be absolutely securely formed, because only in this way is it ensured that the cover thread is bound by the needle threads. In order to eliminate the risk of a missed stitch at the beginning of a seam, the starting needle threads required for stitch formation are annoyingly long. Following termination of sewing, these thread ends must be additionally shortened in order to obtain an optically acceptable sewn product.

A further trimming device for trimming the top cover thread is known from German Patent Specification No. 25 35 316. In this device, a thread pulling hook passes between a leaf spring and a presser foot and catches the top cover thread in order to trap it by means of the raised presser foot and the leaf spring. Then the top cover thread is trimmed by a thread trimmer between the leaf spring and the retracted thread pulling hook. This construction has a large number of parts and is thus expensive. Furthermore, the cover thread trimming operation cannot take place until the presser foot has been raised. This leads to a further time delay in production.

The trimming of the remaining sewing threads at the end of the seam is generally known and is described, for example, in German Patent Specification No. 25 38 916.

SUMMARY OF THE INVENTION

A principal feature of the present invention is the provision of an improved trimming device for trimming a top thread on a sewing machine.

The trimming device of the present invention comprises, a workpiece support, a presser foot, a top cover thread guide, a top cover thread spreader, and a movable thread catching device which co-operates with a knife and a top cover thread trap.

A feature of the invention is that the trimming device operates such that on commencement of sewing, only short thread ends project from the work material and the trimming operation can take place independently of the raising of the presser foot.

Another feature of the invention is that by disposing the thread trap, which is in the form of a counter-plate for the swingable thread catching device, in front of the needles, and combining a thread catching and trimming device therewith, the top cover thread is made to extend transversely from the top cover thread spreader thereby ensuring that it is bound by the needle threads at the start of a seam and enabling the starting needle threads on a workpiece to be kept short.

Yet another feature of the invention is that with this alignment of the top cover thread, it is not necessary for the first stitch to be formed immediately, since it is ensured that the top cover thread is picked up even if the sewing stitches are formed later.

Still another feature of the invention is that since the top cover thread is trapped between the counterplate and the swingable thread catching device, this solution is not dependent on movement of the presser foot.

A feature of the invention is that the thread catching device is preferably disposed between the top cover thread spreader and the upper side of the presser foot, and advantageously a drive shaft engages in a recess in the thread catching device to swing it backwards and forwards.

Another feature of the invention is that the device contributes to a compact construction of the trimming device, and positioning the swingable thread catching device between the top cover thread spreader and the upper side of the presser foot results in a short end to the top cover thread on a workpiece at the end of a seam.

Still another feature of the invention is the provision of an air jet is provided for aligning free needle threads against the direction of sewing, thereby enabling the needle threads to be drawn in almost completely at the beginning of a seam. This is particularly advantageous when sewing tubular workpieces since the end of the seam will cover any incomplete seam beginning.

Further features will become more fully apparent in the following description of the embodiments of this invention and from the appended claims.

DESCRIPTION OF THE PREFERRED EMBODIMENTS

Figure 1:
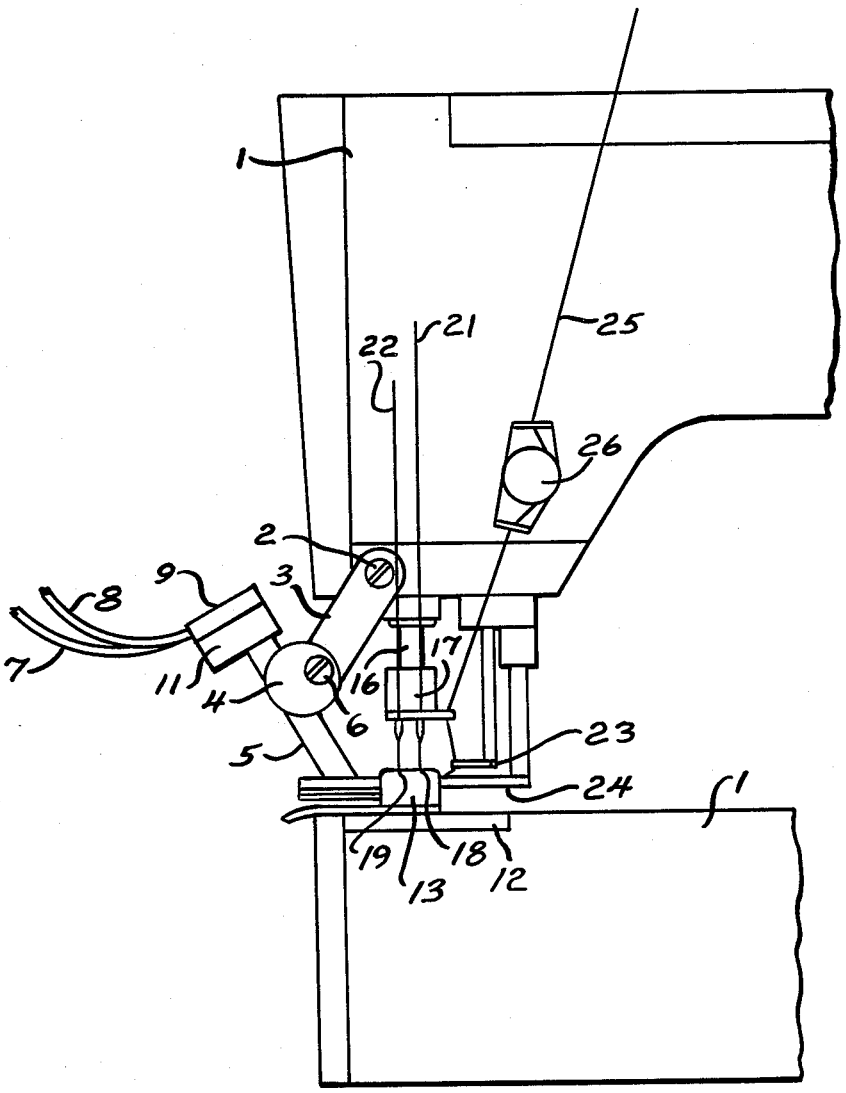
FIG. 1 is a fragmentary side elevational view of a trimming device for trimming the cover thread on a multiple needle sewing machine.

Referring now to FIG. 1, there is shown an arrangement of a trimming device on a multiple needle sewing machine. A support 3 on which a holder 5 for the trimming device is adjustably mounted by means of a slotted claw 4 and clamping screw 6 is fastened to the casing 1 of the sewing machine by a screw 2. Two compressed air lines 7 and 8 are adapted to supply top 11 alternately with compressed air through a lid 9.

A workpiece 15 is clamped between a workpiece support 12 and a presser foot 13 having an upper side 14. A needle bar 16, which can move up or down, carries a needle head 17 which holds a needle 18 and a needle 19, each of which guides a needle thread 21 and 22 respectively.

A slotted top cover thread guide 23 and a driven top cover thread spreader 24 are disposed at the side of the needle head 17. A top cover thread 25 is controlled by a thread brake 26 and is guided to the workpiece 15 by way of an eye 27 in the needle head 17, a slot 28 in the top cover thread guide 23 and a step 29 on the top cover thread spreader 24.

Figure 2:
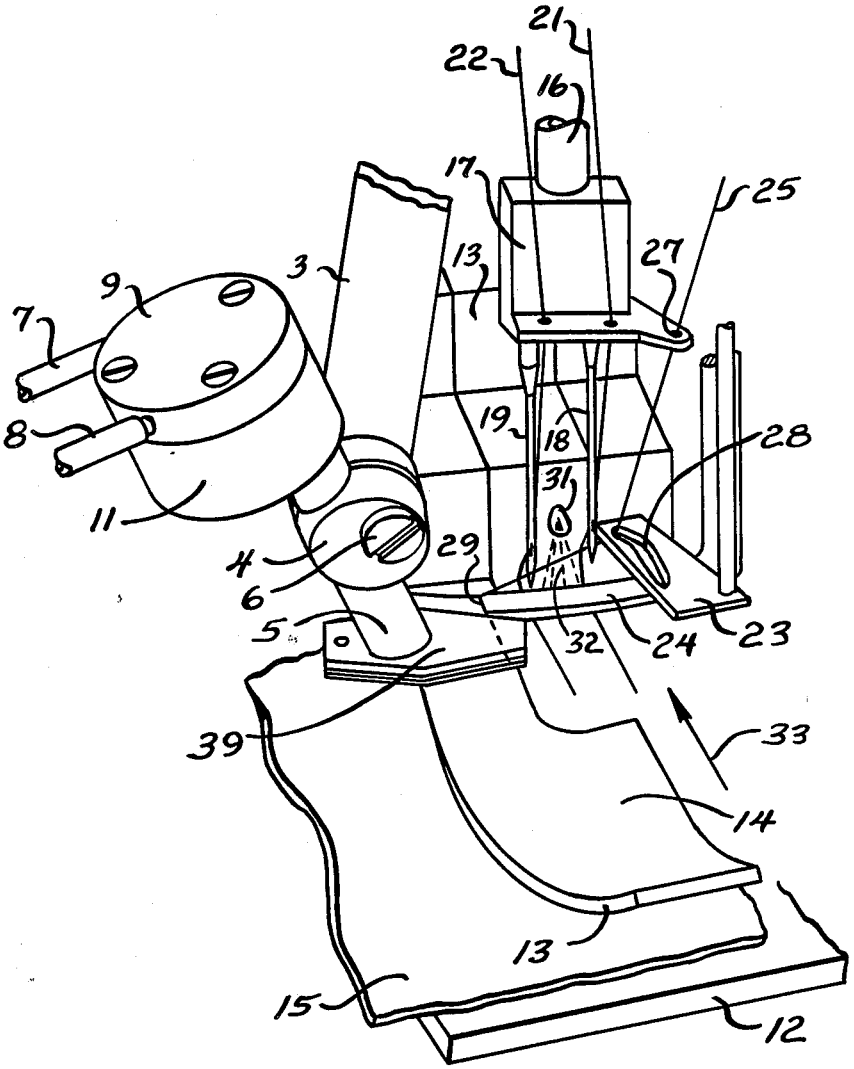
FIG. 2 is a perspective view of the trimming device of FIG. 1 on an enlarged scale.

As illustrated in FIG. 2, the presser foot 13 has between the needles 18 and 19 an opening 31, through which emerges an air jet 32 which aligns the needle threads 21 and 22, which have been trimmed following sewing, against the direction of sewing, that is to say, the direction in which the workpiece 15 is fed during a sewing operation, as indicated by the arrow 33.

Figure 3:
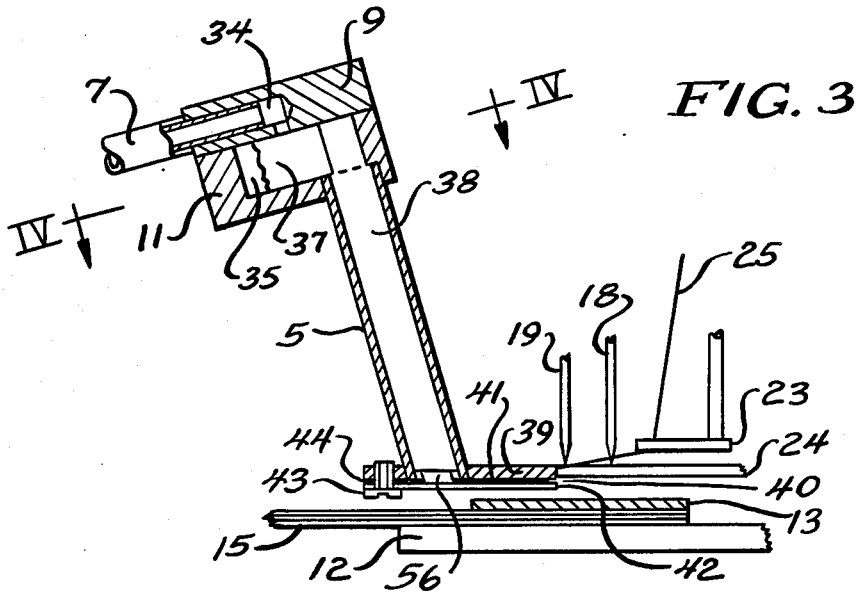
FIG. 3 is a detailed view taken partly in section of the trimming device of FIG. 1.

FIG. 3 is a partially sectional view of the trimming device. Compressed air is fed from the compressed air line 7 through a bore 34 in the lid 9 into a chamber 35 in the top 11. A control device enables the compressed air supply to be changed over so that the chamber 35 can be supplied with compressed air by way of the pressure line 8 and a bore 36 instead. A vane 37 is connected to a drive shaft 38, which is mounted in the holder 5. A counterplate 39 is fastened to the end of the holder 5 facing the workpiece 15. The lower face of the counterplate 39 is aligned with respect to the lower side of the top cover thread spreader 24 in such a way that a thread catching device 41 can swing unimpeded beneath the top cover thread spreader 24. A knife 42 is secured by a screw 43 to the counter-plate 39 and is kept at a distance 40 from the counter-plate 39 by a spacer ring 44.

Figure 4:
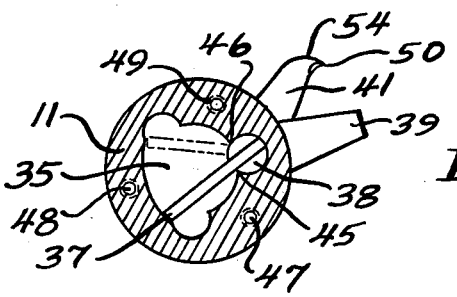
FIG. 4 is a sectional view taken substantially as indicated along the line IV—IV of FIG. 3 showing a thread catching device in a thread catching position.
Figure 5:
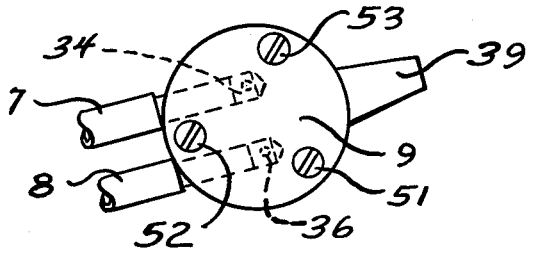
FIG. 5 is a top plan view of a drive for the trimming device with the thread catching device in the thread clamping/trimming position.

FIG. 4 shows the top 11 with the chamber 35 and the vane 37, whose range of swing is limited by stop edges 45 and 46 respectively. Three threaded bores 47, 48 and 49 enable the lid to be fastened by means of three screws 51, 52 and 53. The thread catching device 41 is shown in a thread catching position below the counter-plate 39. It has a cutting edge 50 and a curved edge 54.

Figure 6:
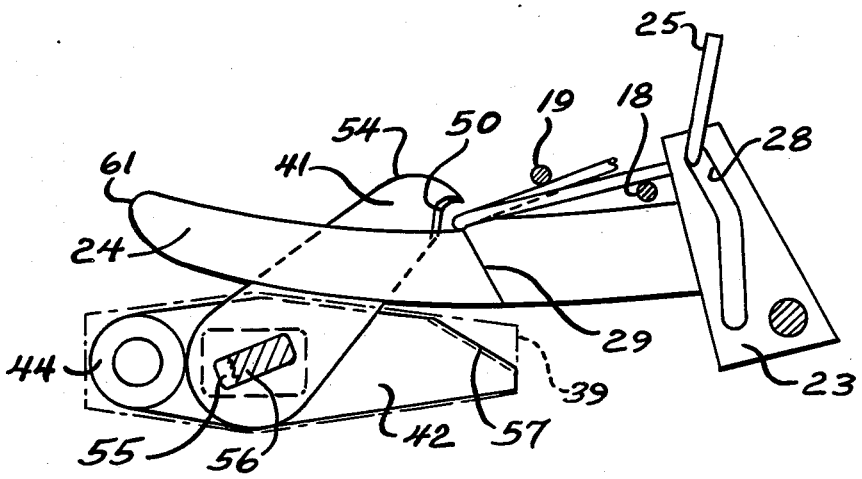
FIG. 6 is a plan view illustrating the thread catching and trimming device in an open position.

FIG. 6 shows the thread catching device 41 has a recess 55 into which extends a flattened end 56 of the drive shaft 38. The knife 42 has a cutting edge 57, an opening 58 and bore 59.

Following termination of the sewing operation, a positioning drive moves the needle bar 16 into a thread cutting position, e.g. into its raised position A spreader drive moves the top cover thread spreader 24 into a lefthand end position 61 as illustrated in FIG. 6. When the top cover thread spreader is in this position, the top cover thread 25 is guided in an angular manner around the step 29 on the top cover thread spreader 24. Disposing the counterplate 39 immediately in front of the top cover thereof means that only a short end of the top cover thread 25 protrudes from the sewn workpiece 15 following trimming.

During a trimming operation, the trimming device, which is, for example, closed during the sewing operation, is opened by the action of compressed air from compressed air tube 7 through the bore 34 into the chamber 35 and hence onto the vane 37 to rotate the drive shaft 38. The curved edge 54 pushes the top cover thread 25 to the side in such a way that when the thread catching device 41 closes, that is, by changing the compressed air over to compressed air tube 8, the top cover thread is caught by the cutting edge 50 of the thread catching device 41.

Figure 7:
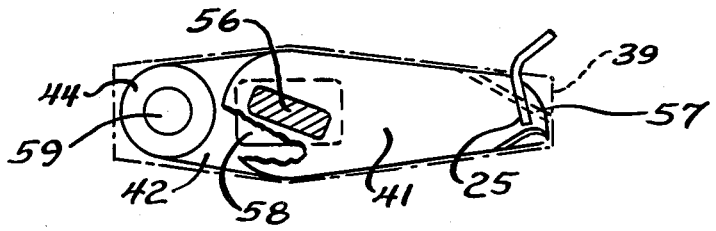
FIG. 7 is a plan view illustrating the catching and trimming device in a closed position.

Since the cutting edge 57 is set back towards the inside below the counter-plate 39, comprising a top cover thread trap, the top cover thread 25 is first trapped between the counter-plate 39 and the thread catching device 41 and then severed by the edge 57 of the knife 42, with the device in a closed position, as shown in FIG. 7. The top cover thread thus extends transversely from the slot 28, behind the needle 18, in front of the needle 19 to the counter-plate 39.

At the start of a seam on a further workpiece to be sewn, the top cover thread is not released by the movement of the workpiece until a new stitch is formed, that is, it is ensured that the top cover thread is bound by the needle threads when a new stitch is being formed. As a result, it is possible to allow the starting needle threads to protrude slightly from the workpiece, since, even if a stitch is missed at the beginning of the seam, the top cover thread is bound by the needle threads when the first needle thread stitch is formed.

The foregoing detailed description is given for clearness of understanding only, and no unnecessary limitations should be understood therefrom, as modifications will be obvious to those skilled in the art.

What is claimed is:

1. A trimming device for trimming a top cover thread on a multiple needle sewing machine comprising, a workpiece support, a presser foot, a top cover thread guide, a top cover thread spreader, and a movable thread catching device which co-operates with a knife and a top cover thread trap, the top cover thread, in operation, being picked up by the thread catching device between a workpiece and the top cover thread guide, in which the top cover thread trap is disposed in front of the needles and is in the form of a counter-plate for the thread catching device, the knife which co-operates with the thread catching device is attached to the counter-plate with a gap therebetween, and the thread catching device is swingable in the gap between the counter-plate and the knife.

2. A trimming device as claimed in claim 1, in which the thread catching device is disposed between the top cover thread spreader and an upper side of the presser foot.

3. A trimming device as claimed in claim 1 in which a drive shaft engages in a recess in the thread-catching device to swing it backwards and forwards.

4. A trimming device as claimed in claim 3, including means for applying compressed air to alternate sides of a vane which is rigidly connected to the drive shaft.

5. A trimming device as claimed in claim 1, in which an air jet is provided for aligning free trimmed needle threads against the direction of sewing.

* * * * *